US005857263A

United States Patent [19]

Chan

[11] Patent Number: 5,857,263

[45] Date of Patent: Jan. 12, 1999

[54] RECONFIGURABLE HAIR DRYING APPARATUS

[75] Inventor: Wing-Kin Chan, Kowloon, Hong Kong

[73] Assignee: China Pacific Trade Ltd., Virgin Islands (Br.)

[21] Appl. No.: 794,347

[22] Filed: Feb. 3, 1997

[51] Int. Cl.[6] ..... A45D 24/10

[52] U.S. Cl. ..... 34/97

[58] Field of Search ..... 34/96, 97; 242/200, 242/385, 385.4; 392/380, 383, 384, 385; D28/13, 15; 248/121, 314

[56] References Cited

U.S. PATENT DOCUMENTS

| | | | |
|---|---|---|---|
| D. 360,282 | 7/1995 | Anzuoni, Jr. et al. | D28/15 |
| 4,219,178 | 8/1980 | Assion | 248/314 |
| 4,528,440 | 7/1985 | Ishihara | 219/370 |
| 5,064,154 | 11/1991 | Payne | 248/121 |
| 5,547,393 | 8/1996 | Jansen | 439/501 |
| 5,590,475 | 1/1997 | Andis | 34/97 |

*Primary Examiner*—Henry A. Bennett
*Assistant Examiner*—Steve Gravini
*Attorney, Agent, or Firm*—Burns, Doane, Swecker & Mathis, L.L.P.

[57] ABSTRACT

A hair drying apparatus comprising a conventional hand-held hair dryer, a hair dryer holder, a power cord retainer and a base, wherein the hair dryer holder has features for removably receiving the hair dryer, for making an elevation adjustment for the hair dryer and for maintaining the position of the barrel of a hair dryer, the power cord retainer comprises features for storing and releasing a length of flexible power cord, such that when the hair dryer is detached from the hair dryer holding means, the hair dryer is connected to the base by a length of flexible cord released from the power cord retainer. In addition, a detachable wall-mount member may be added to this apparatus, making it transformable between hand-held, table-top and wall-mount types of hair dryer which would offer a high degree of flexibility particularly to consumers.

16 Claims, 5 Drawing Sheets

RECONFIGURABLE HAIR DRYING APPARATUS

FIELD OF THE INVENTION

The present invention relates to a hair drying apparatus, and more particularly to a hair drying apparatus which can be transformed between hand-held, wall-mountable and table-top operating modes.

BACKGROUND OF THE INVENTION AND PRIOR ART

Hair dryers can be divided into three main structural types: hand-held, wall-mountable and table-top types. Among these three types, the portable hand-held type is probably the most commonly and widely used one which can be found in almost every modern household.

A hand-held hair dryer usually comprises an elongate barrel inside which an electric heater and a fan-blower are accommodated. Air for hair drying usually travels along the barrel in response to the accelerating force generated by the fan-blower. The accelerated air, heated or un-heated, is then caused to leave the hair dryer through a free end of the barrel. A handle is usually provided and connected to the barrel substantially at right angles to it and near its other end. This type of hand-held hair dryer is usually provided with a length of flexible power cord which is connected to the hair dryer through an opening at the bottom part of the handle portion.

A major advantage of this hair dryer type is that it can easily be moved around and flexibly positioned about the head to achieve optimum hair drying or styling. However, a user has to hold the hair dryer throughout the entire drying process which can be a tiring exercise. In addition, since a user must hold the dryer in one hand, only one hand is free to use other styling tools such as a brush or curling iron. Sometimes an unwary person may be burnt by the hot barrel of a hand-held hair dryer which has been left lying around just after use. Another disadvantage of this hair dryer is that the long power cord may easily get entangled and requires constant dis-entanglement.

Wall-mounted hair dryers are most commonly found in commercial or recreational establishments such as hotels or swimming pools. This type of hair dryer usually comprises a bulky and permanently wall-mounted compartment housing inside which an electric heater and a fan-blower are mounted. In one form of this hair dryer, the air-outlet is usually fixed on the compartment housing with an adjustable air exit-angle. In an alternative form, the air-outlet is connected via a length of flexible hose to the compartment.

This wall-mounted type of hair dryer is particularly useful when a user wishes to have his/her hair dried within a short time. This style of hair drying, more commonly known as the "ready-to-go" drying style, is particularly suitable for the wall-mounted type since both hands of the user are left free and a user can therefore use his/her fingers to plough or comb through the hair to help speed up hair drying.

However, when using a wall-mount hair dryer, a user usually has to bend or stoop their body and move his/her head around to get close to the air-outlet in order to enjoy the benefits of hands-free operation. It is also usual that a user has to remaining standing all the time while using the dryer. When a user is too tall or too short compared to the mounted position of the hair dryer, its use becomes awkward, uncomfortable and even difficult.

Moreover, because a wall-mounted unit is usually permanently mounted, it would be difficult to relocate it once installed. This is probably the main reason why the wall-mount type is not commonly used at homes even though it provides great benefits.

The table-top hair dryer is a hybrid between the wall-mount and table-top types. This hair dryer type provides hands-free operation while allowing a hair dryer to be moved around. Such a hair dryer can be moved to and placed in almost any place and can operate from wherever the user feels most comfortable or convenient. It is especially useful when a user wishes to dry the hair on the sides or the back of the head and particularly so when he or she does not have very flexible hand or arm joints.

With such a table-top hair dryer, a user can for example enjoy hands-free hair drying and styling under the comfort of room air-conditioning and with the luxury of sitting in front of a dressing table or even below a shelf on which a hair dryer appropriately stands. Also, it would be more convenient for an adult to take care of the hair of a child using a table-top hair dryer when both his/her hands are left free.

A desk-top hair dryer usually comprises a conventional patentable hand-held hair dryer and a table-top stand which is permanently mounted to the body of the hair dryer. The table-top stand is usually a retractable tripod which can be pivotally expanded to form a supporting base. However, because of the built-in stand, the handle of the hair dryer usually becomes too bulky and is quite difficult or uncomfortable to use as a hand-held hair dryer.

Similar to a hand-held hair dryer, a table-top hair dryer usually has an un-restrained length of power cord which is a potential source of hazard that requires particular attention. Furthermore, the centre of gravity of a table-top apparatus having a tripod-type stand is usually quite high which means that such a hair dryer can easily topple over when supported only by a tripod-type stand.

From the above, it would be appreciated that each hair dryer type possess useful and advantageous features which are characteristic of their specific structural type. However, each hair dryer type also has some typical drawbacks. It would therefore be beneficial if an improved hair drying apparatus having the advantages of more than one type of hair dryer while having their respective inherent disadvantages alleviated is provided.

For example, it would be beneficial if a hair drying apparatus having the combined advantages of hand-held and table-top type hair dryers but without having a bulky handle were made available. Thus, it would be convenient if a user can use the apparatus reversibly as a hand-held hair dryer without a bulky handle and as a table-hair dryer without a surplus length of annoying power cord.

Furthermore, it would also be desirable if there were provided a hair drying apparatus having the combined advantages of hand-held, table-top and wall-mounted type hair dryers which can be reversibly used in a different operating mode.

SUMMARY OF THE INVENTION

According to the present invention, there is therefore provided a hair drying apparatus comprising a hand-held hair dryer, a hair dryer holding means, a power cord retaining means and a base, wherein said hand-held hair dryer comprises a handle, a length of flexible power cord and an elongate barrel, said hair dryer holding means comprises means for removably receiving said hair dryer and for maintaining said barrel of said hair dryer in an operative position, said power cord retaining means comprises means for storing and releasing a length of said flexible power cord, such that when said hair dryer is detached from said hair dryer holding means, said hair dryer is connected to said base by a length of flexible cord released from said power cord retaining means, and said base is adapted to allow said apparatus to rest on a table-, shelf-top or other similar surfaces.

Preferably, said hair dryer holding means comprises a receptacle for receiving the handle of said hand-held hair dryer and preferably the elevation angle of said hair dryer holding means can be altered so that when said hand-held hair dryer is held in place by said hair dryer holding means, the elevation angle of said barrel of said hand-held hair dryer would simultaneously be adjusted in response to the adjustment made to said holding means.

Preferably said hair dryer holding means can be adjusted so that the height of said barrel of said hand-held hair dryer above said base may be altered accordingly.

According to another aspect of the present invention, there is provided a hair drying apparatus comprising a hand-held hair dryer, a hair dryer holding means, a power cord retaining means and a wall-mountable member, wherein said hand-held hair dryer comprises a handle, a length of flexible power cord and an elongate barrel, said hair dryer holding means comprises means for removably receiving said hair dryer and for maintaining said barrel of said hair dryer in an operative position, said power cord retaining means comprises means for storing and releasing a length of said flexible power cord, such that when said hair dryer is detached from said hair dryer holding means, said hair dryer is connected to said holding means by a length of flexible cord released from said power cord retaining means, and said wall-mountable member is adapted to allow said apparatus to be detachably mounted on a wall or other hard surfaces.

Preferably said wall-mountable member is removably detachable from said power cord retaining means and preferably said hair dryer holding means is removably detachable from said wall-mountable member.

Preferably said hair dryer holding means comprises a receptacle for receiving the handle of said hand-held hair dryer and the elevation angle of said hair dryer holding means can be altered in order to adjust the elevation angle of said barrel of said hand-held hair dryer.

BRIEF DESCRIPTION OF THE DRAWINGS

The present invention will now be explained and illustrated by way of examples and with reference to the accompanying drawings, in which.

DETAILED DESCRIPTION OF THE PREFERRED EMBODIMENTS

Figure 1A:
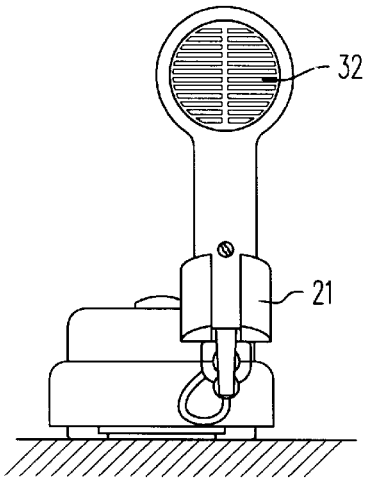
FIG. 1*a* and 1*b* are the front and side views of a first embodiment of the present invention showing a combined table-top and hand-held hair dryer.

Referring to FIGS. 1 to 5, there is shown a hair drying apparatus 1 comprising a base 10, a hair-dryer holding means 20, a hand-held hair-dryer 30 and a power cord retention means 40.

The base 10 comprises a base-stand 11 and a base-housing 12 which is mounted to the base stand. The base 10 is adapted to provide support to the whole apparatus so that it can rest comfortably and stably on a rigid surface such as a table- or shelf-top. In other words, the base-stand 11 is a foundation of the whole apparatus which supports all other components of the apparatus, such as the power cord retention means 40, hair dryer 30 and the hair dryer holder 20, which are provided on the base 10. In the present embodiment, the base stand comprises a rigid plate which can rest on a flat surface. The hair-dryer holding means 20 comprises a receptacle 21 which is adapted to removably receive a hand-held hair dryer. The receptacle 21 is designed so that when the hair dryer is properly held in place by the receptacle 21, the hair dryer barrel 31 and air-outlet 32 will be maintained at a predetermined orientation and elevation which are suitable for hair drying. Naturally, this would usually correspond to a position of the barrel in which the air-outlet 32 is facing a user.

Figure 1B:
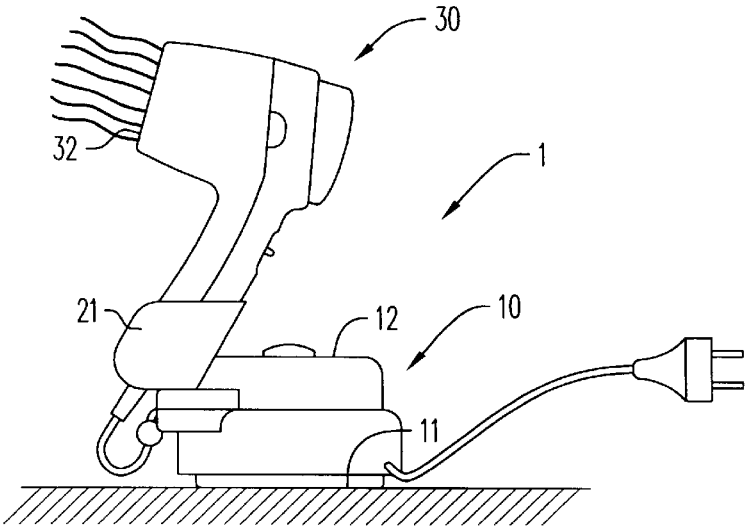

The receptacle 21 shown in FIG. 1 comprises a tubular member having an open upper-end 22 and a partly closed lower-end 23. The receptacle is mounted on the base 10 and at a pre-determined elevation angle with respect to the base stand. This tubular member is adapted to receive the lower handle portion 33 of the hair dryer 30 so that the free end of the handle can be slid in and out of the tubular receptacle through its upper-end 22. The lower end 23 of the tubular member is partly blocked so that the remaining open area is smaller than the cross-section of the free-end of the hair dryer handle 33. This partly blocked lower end 23 prevents passage of the handle beyond the lower end of the receptacle 21, thereby maintaining the minimum height of the hair dryer barrel above the base 10.

A longitudinal aperture 24 wide enough to allow unhindered passage of the power cord through the receptacle is formed from the upper end of the receptacle 21, along the front part and extends substantially into the lower end 23 of the tubular member. This aperture divides the tubular member into left- and right-parts which are connected by the back of the tubular member. When the handle of a hand-held hair dryer is placed inside the receptable, it will then be embraced by the left- and right-members and held in place.

Figure 2A:
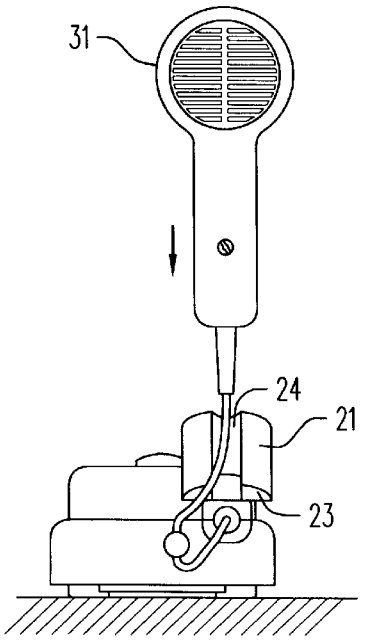
FIG. 2*a* and 2*b* shows how the handle of a hair dryer is being inserted into the receptacle of the hair dryer holding means of the apparatus of FIG. 1.
Figure 2B:
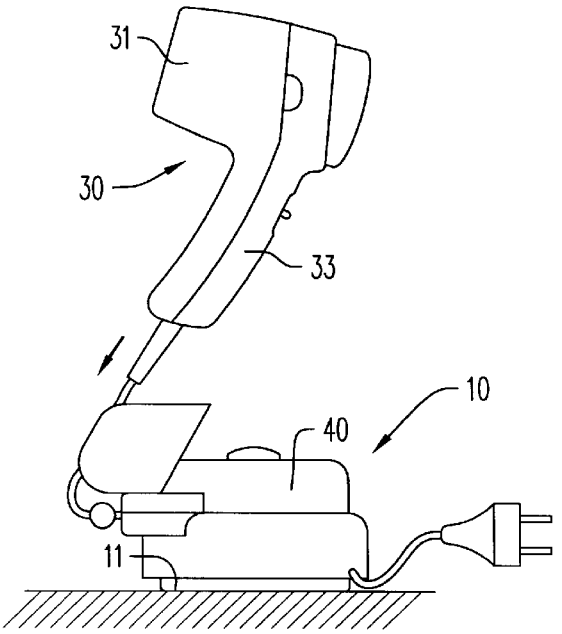
Figure 3:
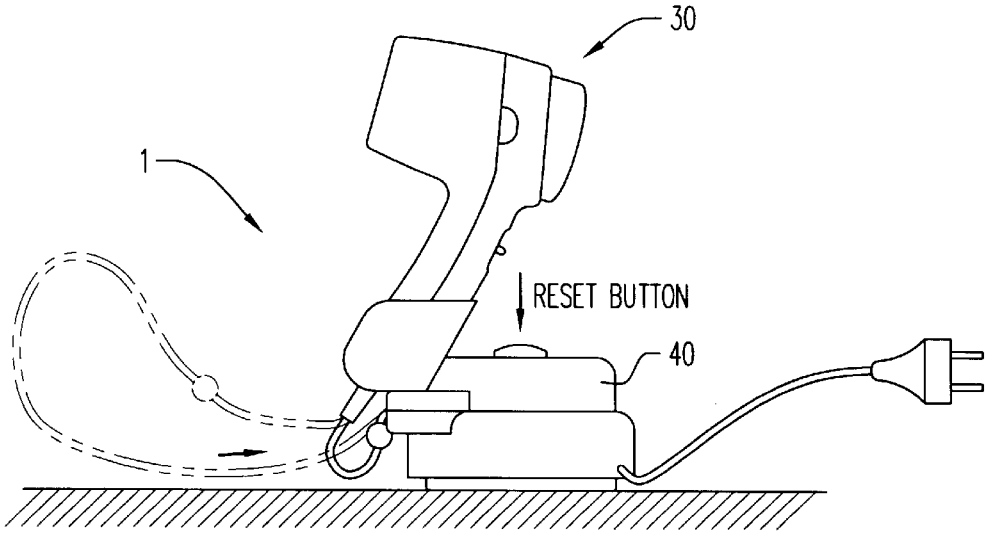
FIG. 3 shows an extra length of power cord being retreated into the power cord retention means of the embodiment of FIG. 1.
Figure 4:
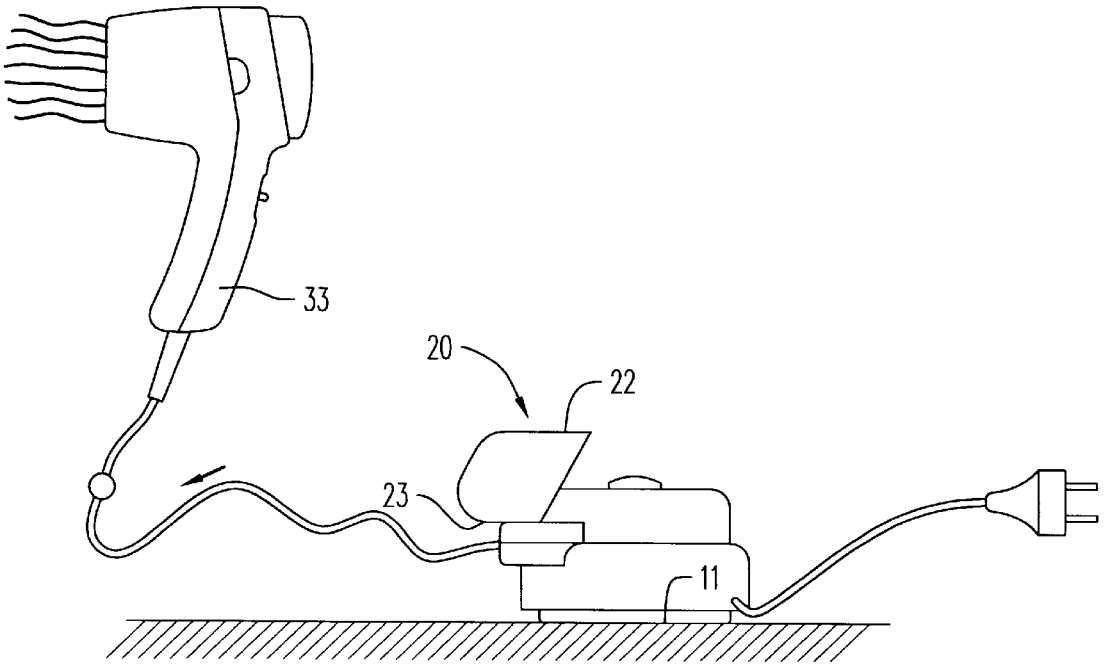
FIG. 4 shows the apparatus of FIG. 1 being used as a hand-held hair dryer.

The aperture provides an exit gate-way for the power cord so that when the hair dryer is being removed from the receptacle 21, as shown in FIGS. 2 & 4, the power cord can be moved totally clear of the receptacle 21 and the receptacle would not affect or hinder to any extent the hair dryer movement at all. When the hair dryer handle 33 is placed in the receptacle 21, the aperture formed on the lower-end 23 of the receptacle provides an escape for the power cord lead so that the hair dryer handle can be comfortably received by the receptacle and the elevation of the hair dryer barrel is repeatable.

Alternatively, instead of a using a single rigid tubular member, the receptacle may also comprise a pair of spring-biased bracket members each of which is hinged with spring bias so that a handle could be held firmly in place by the pair of spring biased arms. In a simplified form, the receptacle may also be realised by a clip-type retention means so that a handle may be snap-fitted into and retained by the receptable.

Figure 5A:
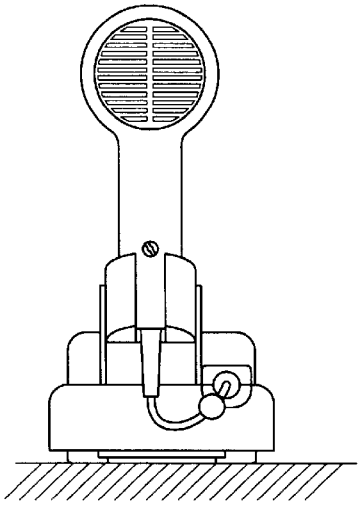
FIG. 5*a* and 5*b* show the embodiment of FIG. 1 further having an adjustable hair dryer holding means.
Figure 5B:
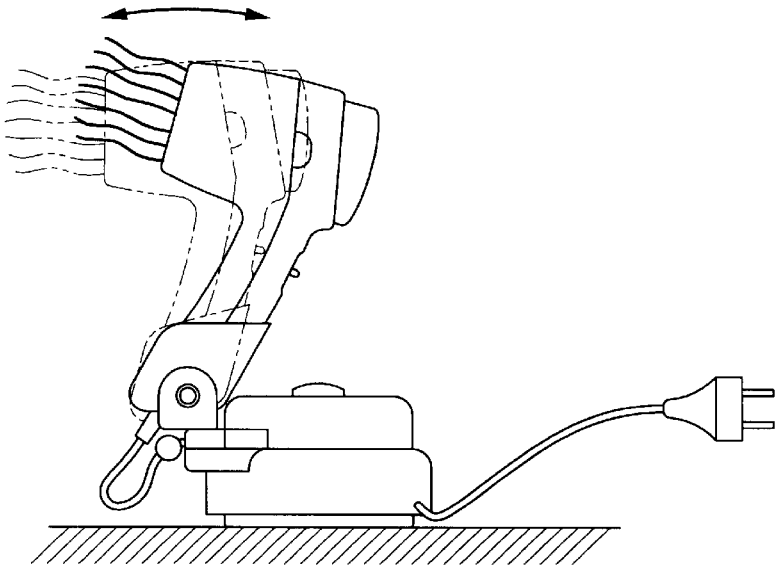
Figure 6:
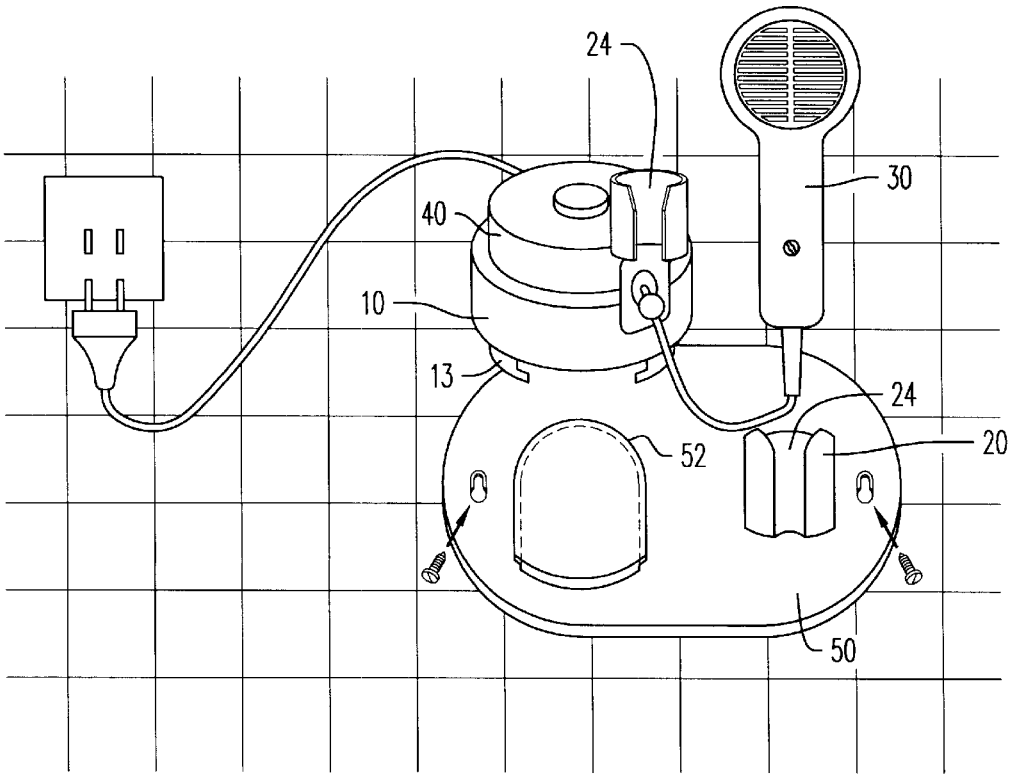
FIG. 6 is an assembly drawing of a second embodiment of the present invention showing a combined wall-mount and hand-held hair dryer.
Figure 7:
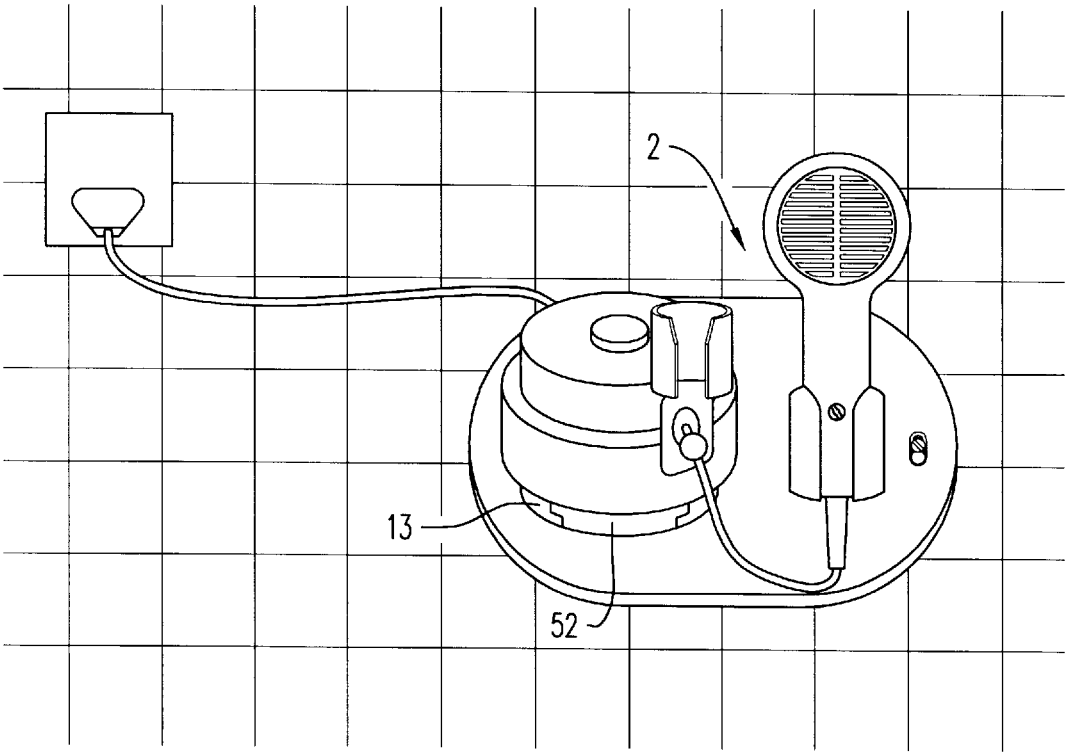
FIG. 7 & 8 show respectively the front and side views of the embodiment of FIG. 6 when assembled as a wall-mount apparatus.
Figure 8:
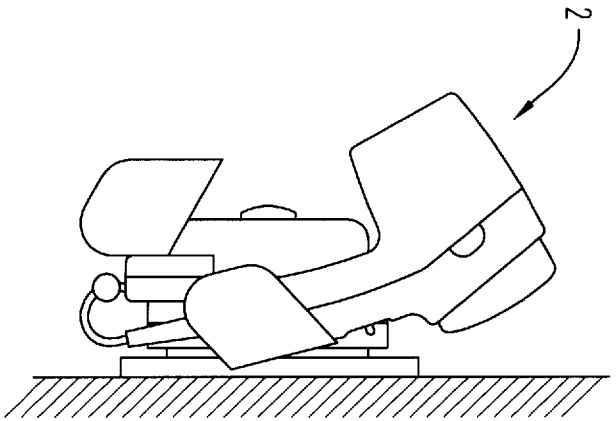
Figure 9:
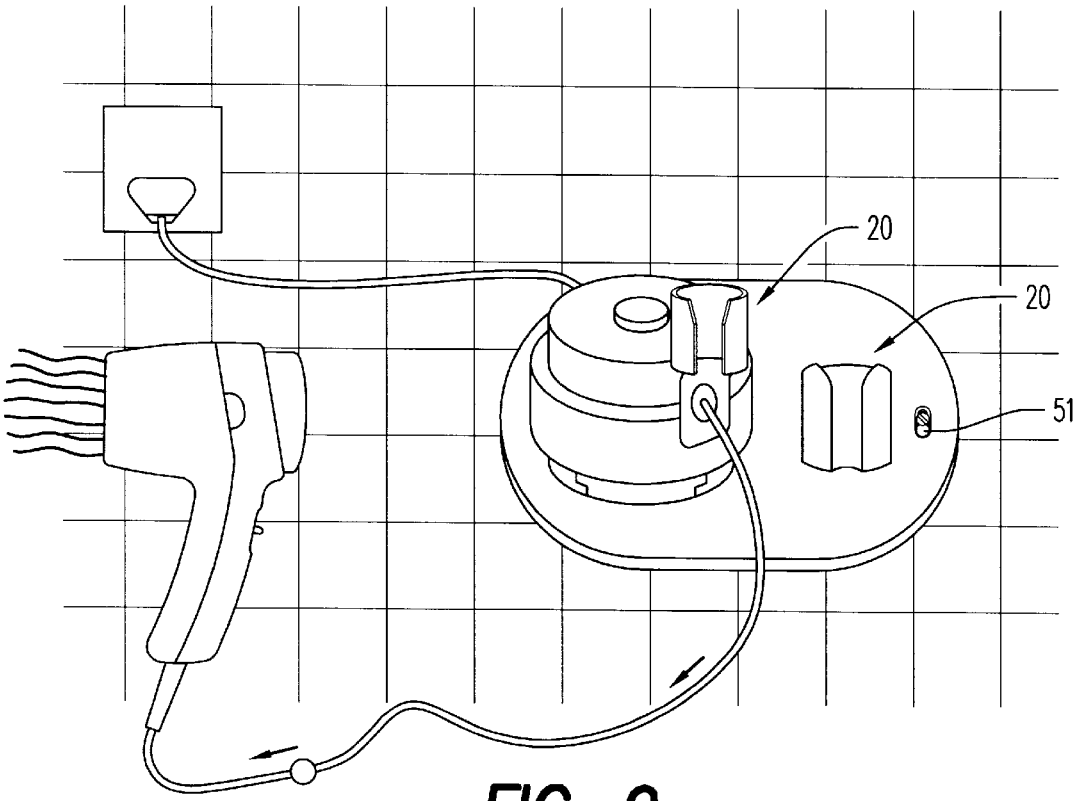
FIG. 9 shows the embodiment of FIG. 7 being used as a hand-held hair dryer.
Figure 10:
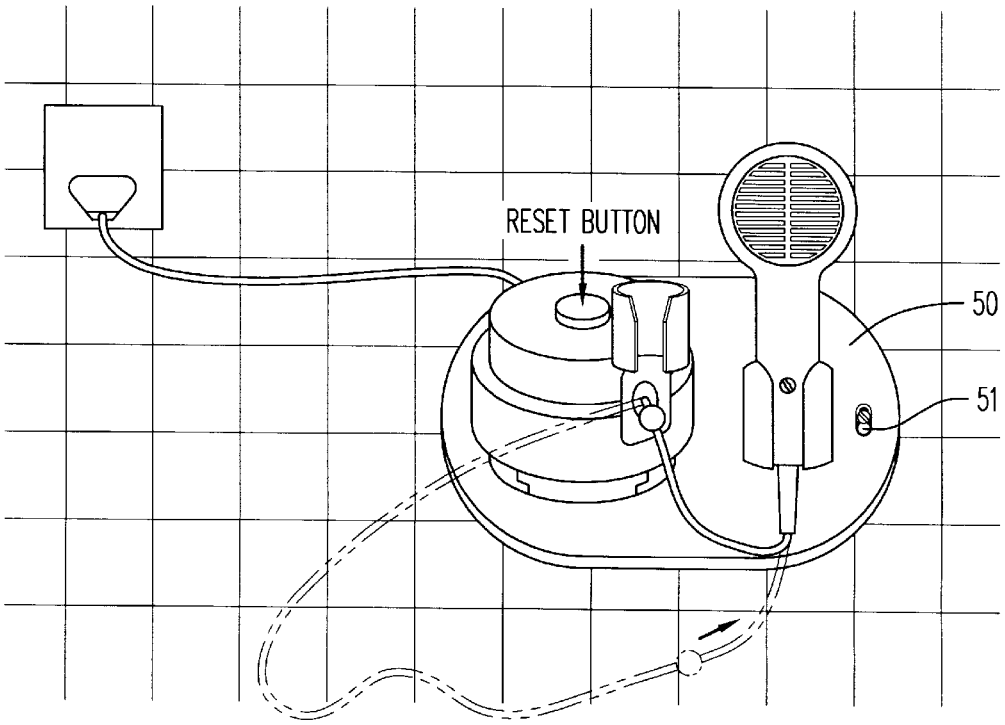
FIG. 10 shows how an extra length of power cord is being retreated into the power retention means of the embodiment of FIG. 9.

Referring to FIG. 5, to make the table-top hair dryer more flexible and user friendly, the elevation angle of a receptacle is adjustable so that the elevation angle of the hair dryer barrel can be adjusted according to the personal preference or convenience of the user. To achieve this, the receptacle is mounted on the base housing via an elevation angle adjustment means. This elevation angle adjustment means may, for example, be realised by means of a toothed wheel in combination with a catch member which together maintain the elevation angle of the receptacle and therefore that of the hair dryer barrel 31. Alternatively, other pivotal type, ball- or universal-joint type elevation angle adjustment means may be used.

To make the hair dryer even more flexibile to use, the height of the hair dryer above the base stand 11 can be adjusted. This could for example be done by mounting the hair dryer receptacle 21 on a height extension device so that its height above the apparatus base could be easily adjusted and maintained by the user. A telescopic or bellow-type height extender would be suitable for this purpose.

A power cord retaining means 40 comprising a power cord restraining mechanism is mounted on the apparatus base and enclosed within the base housing 12. This power cord retaining means is provided so that surplus length of power cord which is not required when the apparatus is being used as a table-top or wall-mount type hair dryer, or when it is not being used at all, could be restrained and stored within the base housing 12. When a major portion of the power cord is restrained and stored on the base, potential hazards due to unrestrained power cord could be largely reduced, making this apparatus more suitable for domestic use.

The retaining means (not shown) used in the embodiment of FIG. 1 comprises a retraction mechanism installed on the base stand. The retraction mechanism comprises a spring-biased ratchet wheel on which a length of power cord could be wound. The ratchet wheel is normally engaged by a catch member in a manner which would allow the wheel to turn in a direction to release power cord while at the same time increasing the reverse direction spring bias energy. When the catch member is released from the engaging position, the ratchet wheel will be released and the spring bias would cause the wheel to turned in the opposite direction in order to retract the length of power cord which has been released so that portion will again be wound on the wheel and stored within the base housing 12.

Alternatively, the power cord retention means can be made simpler and realised by mounting a rotatable wheel on the apparatus base so that the power cord can be released and retracted by simple wheel rotation. In a more economic way, the retention means can be realised simply by mounting a plurality of hooks on the surface of the apparatus base so that a length of power cord can be wound and un-wound manually about the periphery formed by the hooks.

When a surplus length of power cord is being retained by the retention means and stored on the base stand, the apparatus base becomes heavier and is therefore more stable compared to a conventional table-top device using a tripod stand.

Referring to FIGS. 6–10 there is shown a second embodiment of the present invention in which a very handy and flexible form of wall-mountable hair dryer is described. The apparatus 2 in this embodiment comprises a wall-mounted member 50 on which a base 10, a power cord retention means 40, a hair dryer holding means 20 and a hand-held hair dryer 20 are mounted. In this embodiment, this wall-mount hair dryer comprises a wall-mount member carrying a table-top hair dryer 1 described above. The wall-mountable member 50 of the present embodiment comprises a rigid wall-mounting plate having a plurality of openings 51 for engaging with retention means already formed on a wall or other similar surfaces. The retention means can for example be nails, screws, nuts, hooks or the like which are suitable for supporting a wall-mounted apparatus. Preferably the wall-mountable member can be mounted or detached from a wall without requiring tools.

One way of making possible such convenient mounting and detaching is for example by providing openings which have top and bottom sections in communication with each other. In this type of opening, the top section has a smaller opening and the bottom section has a larger opening. Such an opening design is useful since the bottom and larger section would allow through-passage of the head portion of a retention means, which normally has the largest cross-section, while the smaller section would prevent passage of the head portion while allowing passage of the stem portion.

After the wall-mountable member has been inserted into the retention means through the bottom opening, its weight will cause the wall-mountable member to drop and cause it to be engaged by the upper and smaller section, thereby securing the wall-mountable member between the head portion of the retention means and the wall. When the wall-mountable apparatus is to be detached, it can be lifted slightly upwards and removed through the larger bottom openings. With such a removable wall-mounting means, a wall-mountable apparatus can be easily wall-mounted or detached without requiring tools and is therefore very user friendly.

On the wall-mountable member there is mounted a hair-dryer holding means which is adapted to hold a hand-held hair dryer so that when the hair dryer is held in place by the holding means, the hair dryer barrel is maintained at a position and in a manner suitable for use as a wall-mounted hair dryer. In the present embodiment the holding means comprises a receptacle 20 identical to that used in the table-top type which is mounted on the wall-mount plate. Preferably this hair dryer holding device is also equipped with elevation angle and height adjustment means to provide increased device flexibility. In addition, a power cord retaining means similar to that used in the previous embodiment is also mounted on the wall-mountable plate and in the neighbourhood of the hair dryer holding means. This retaining means allows the apparatus to be transformable between hand-held and wall-mounted types. When a user wishes to transform the wall-mounted apparatus into a hand-held apparatus, he simply needs to remove the hair dryer handle from the holding means and pull it away from the wall-mountable member. The power cord retaining means would then release a length of power cord corresponding to the amount pulled by the user. When it is to be transformed back to the wall-mounted type, the user can simply replace the hair dryer handle back to the receptacle and release the catch member on the retention means. The power cord retraction mechanism, if provided, will then retract the surplus length of power cord and store it within the base housing.

Where the hair dryer holding means 20 of the apparatus is equipped with elevation angle and height adjustment means, the apparatus can be transformed into table- or shelf-top hair dryer when it is detached from a wall and is placed on the back of its wall mount member on a table-top. In this case, the apparatus is then transformable between hand-held, wall-mount and table-top modes. When this apparatus is transformed into the table-top type while retaining the wall-mountable member, the wall-mountable member becomes a more stable base stand because of its usually larger foot-print.

To make the present apparatus more flexible, easier for packaging and transportation together with the added flexibility of reconfiguaration between various hair dryer types, the apparatus can be assembled in modular form. For example, the wall-mountable hair dryer can be assembled by attaching a table-top hair dryer module to a wall-mountable member module. This can be done if the base stand 11 of a table-top hair dryer is formed with a coupling means 13 which can interlock with a corresponding coupling means 52 formed on the wall-mountable member.

In the present embodiment, the bottom of the base-stand 11 is formed as a retention hook which can interlock with a correspondingly shaped hook on the wall mount member 50. In this way, the table-top module can be removably detachable from the wall-mountable member and when a wall-mounted hair dryer is detached from the wall, the apparatus can appear as two forms of table-top hair dryer: one standing simply on the base stand and the other standing on the wall mount member which then becomes a new base stand. For those who prefer a more stable base, a table-top apparatus 1 mounted on a wall-mountable member is probably a more stable choice since this new base has a larger base foot-print.

Thus the present invention has described a very sophisticated hair drying apparatus which can be transformed into and between many different ways in order to meet and satisfy the many different requirements of a user by a single apparatus.

I claim:

1. A hair drying apparatus reconfigurable between table-top and wall-mountable use, comprising a hand-held hair dryer, a hair dryer holding means, a power cord retaining means and a base, wherein:

said hand-held hair dryer comprises a handle, a length of flexible power cord and an elongate barrel, said hair dryer holding means comprises means for removably receiving said handle of said hair dryer and for maintaining said barrel of said hair dryer in an operative position in both the table-top and wall-mountable configurations, said power cord retaining means comprises means for storing and releasing a length of said flexible power cord, such that when said hair dryer is detached from said hair dryer holding means, said hair dryer is connected to said base by a length of flexible cord released from said power cord retaining means, said base is adapted to support said hair dryer for operation on a table-top, shelf-top and other similar support surfaces, and said power cord retaining means abuts said base and provides a variable counter-weight near the base for maintaining stability of said hair dryer when the same is used as a table-top device.

2. A hair drying apparatus according claim 1 wherein said hair dryer holding means comprises a receptacle for receiving the handle of said hand-held hair dryer.

3. A hair drying apparatus according to claim 1 wherein the elevation angle of said hair dryer holding means can be altered so that when said hand-held hair dryer is held in place by said hair dryer holding means, the elevation angle of said barrel of said hand-held hair dryer would simultaneously be adjusted in response to the adjustment made to said holding means.

4. A hair drying apparatus according to claim 1 wherein said hair dryer holding means can be adjusted so that the height of said barrel of said hand-held hair dryer above said base may be altered accordingly.

5. A hair drying apparatus according to claim 2 wherein said receptacle comprises a tubular portion having an open top-end and a partly closed lower-end, said open top-end permitting insertion of said handle of said hair dryer into said receptacle and said partly closed lower-end preventing advancement of said handle beyond said lower-end.

6. A hair drying apparatus according to claim 1 wherein said power cord retaining means is enclosed within a base housing formed on said base such that when a length of power cord is being retracted and stored by said retaining means said power cord is stored within said base housing.

7. A hair drying apparatus according to claim 1 wherein said power cord retaining means comprises means for retracting a length of power cord towards said base.

8. A hair drying apparatus according to claim 1 wherein said base comprises a base stand on which said apparatus is supported.

9. A hair drying apparatus according to claim 8 wherein said base stand comprises a coupling means adapted for detachable interlocking with a corresponding coupling means formed on another surface.

10. A hair drying apparatus according to claim 9 wherein said base stand comprises a coupling means adapted for detachable interlocking with a wall-mounted member on which there is provided a correspondingly shaped coupling means.

11. A hair drying apparatus comprising a hand-held hair dryer, a hair dryer holding means, a power cord retaining means and a wall-mountable member, wherein;

said hand-held hair dryer comprises a handle, a length of flexible power cord and an elongate barrel, said hair dryer holding means comprises means for removably receiving said handle of said hair dryer and for maintaining said barrel of said hair dryer in an operative position, said power cord retaining means comprises means for storing and releasing a length of said flexible power cord, such that when said hair dryer is detached from said hair dryer holding means, said hair dryer is connected to said base by a length of flexible cord released from said power cord retaining means, said base is adapted to support said hair dryer for operation on a table-top, shelf-top and other similar support surfaces when said hair dryer is being used as a table-top device, said power cord retaining means abuts said base and provides a variable counter-weight near the base for maintaining stability of said hair dryer when the same is used as a table-top device, and said wall-mountable member is adapted to allow said apparatus to be detachably mounted on a vertical support surface.

12. A hair drying apparatus according to claim 11 wherein said wall-mountable member is removably detachable from said power cord retaining means.

13. A hair drying apparatus according to claim 11 wherein said hair dryer holding means is removably detachable from said wall-mountable member.

14. A hair drying apparatus according claim 11 wherein said hair dryer holding means comprises a receptacle for receiving the handle of said hand-held hair dryer.

15. A hair drying apparatus according to claim 11 wherein the elevation angle of said hair dryer holding means can be altered in order to adjust the elevation angle of said barrel of said hand-held hair dryer.

16. A hair drying apparatus according to claim 11 wherein the separation between said hair dryer holding means and said wall-mount member can be adjusted.

* * * * *